US006442774B2

(12) United States Patent
Wilson et al.

(10) Patent No.: US 6,442,774 B2
(45) Date of Patent: Sep. 3, 2002

(54) COVER MEANS

(75) Inventors: Tim Wilson; Jamie Fraser; Patrick Thorpe; David Atkins; John Whiteside, all of Witney (GB)

(73) Assignee: Certikin International Ltd., Witney (GB)

( * ) Notice: Subject to any disclaimer, the term of this patent is extended or adjusted under 35 U.S.C. 154(b) by 0 days.

(21) Appl. No.: 09/848,927

(22) Filed: May 4, 2001

(30) Foreign Application Priority Data

May 4, 2000 (GB) ..... 0010676

(51) Int. Cl.[7] ..... E04H 4/00
(52) U.S. Cl. ..... 4/504; 4/507; 4/292
(58) Field of Search ..... 4/286–292, 504, 4/507–509, 652

(56) References Cited

U.S. PATENT DOCUMENTS 2,783,852 A * 3/1957 Sisk ..... 4/292
3,378,858 A * 4/1968 Jacuzzi ..... 4/289
4,115,878 A * 9/1978 Johnson et al. ..... 4/292
4,134,162 A * 1/1979 Sharland et al. ..... 4/292
4,170,047 A * 10/1979 Corsette et al. ..... 4/286
4,505,814 A * 3/1985 Marshall ..... 4/286
5,809,587 A * 9/1998 Fleischer ..... 4/287
6,314,590 B1 * 11/2001 Lee ..... 4/287

* cited by examiner

*Primary Examiner*—David J. Walczak
*Assistant Examiner*—Tuan Nguyen
(74) *Attorney, Agent, or Firm*—Woodard, Emhardt, Naughton, Moriarty & McNett

(57) ABSTRACT

A cover is provided for an end of a conduit. The cover comprises a front face covering the conduit end and a back face having fasteners for attachment to a conduit. A plurality of apertures pass between the front face and back face to allow the flow of liquid to and/or from the conduit. The edges of the front face defining the entrances to the apertures are non-planar. In addition to, or as an alternative to, the apertures are formed such that the flow of liquid between the front and back faces is deflected so that the liquid follows at least two directions in passing between the front and back faces. The cover can be used as a grille over drainage in a swimming pool.

5 Claims, 3 Drawing Sheets

COVER MEANS

This invention relates to cover means, and particularly to a cover means for covering drains in swimming pools.

Although the present invention refers almost exclusively to a covet means for a swimming pool, it will be appreciated by persons skilled in the art that the cover means can be used to cover any conduit. For example, the covering means can be used to covet a conduit which is submerged in a liquid, such as found in a bath, a Jacuzzi, in an industrial process or the like. However, it is also noted that the covering means can be used to cover a conduit which is not submerged in a liquid.

There have been a number of recent cases of people, particularly children, getting fingers and/or hair, for example, trapped in grilles covering drain means in swimming pools. Since the grilles are underwater, if the trapped person is not released within a short space of time they may drown. A further problem which is known to occur with conventional grilles in swimming pools is the risk of a person being sucked against the grille, thus causing a vacuum against the same and preventing the person being released. This may again result in the trapped person drowning if they cannot be released within a short space of time.

It is therefore an object of the present invention to provide a cover means for an end of a conduit, drain means or the like, which prevents a person being trapped and prevents the formation of a vacuum against the same.

According to a first aspect of the present invention there is provided a cover means for an end of a conduit, said cover means comprising a front face coveting said conduit end, a back face having attachment means for attachment to said conduit and a plurality of apertures which pass from said front face to said back face to allow the flow of a liquid to and/or from the conduit and characterized in that edges of said front face defining the entrances to said apertures are non-planar.

Typically the apertures are of such dimensions that it is unlikely for a person to get their fingers, hair and/or other body parts trapped in the same. Since the entrances to the apertures ate ton-planar it is difficult, if not impossible, for a vacuum to be created against the cover means by part or whole of a person's body.

Typically the end of the conduit and cover means are submerged in liquid during normal use. However, it is noted that the cover means can be used as a conventional grille, covet over a conduit or drain, which is not submerged in liquid during normal use.

Preferably the cover means is utilised as a grille covering a drainage means in a swimming pool.

Preferably the front face of the cover means is non-planar and further preferably the front face has a convex surface.

Further preferably the front face of the covet means is circular.

In one embodiment apertures are provided at one or more locations around the periphery or edge of the front face of the covet means to enable flow of liquid via the same. It is unlikely that all the apertures on the front face and the apertures on the edge of the cover means will be covered at one time and this reduces the likelihood of a vacuum being created against the covet means.

Preferably the attachment means ate releasable so that the cover means can be removed for cleaning, maintenance and/or the like.

Further preferably the attachment means include nuts and bolts, clip means, a threaded fitting, screws and/or the like.

Typically the attachment means ate positioned on a substantially central part of the back face of the cover means.

The cover means can be used to replace conventional grilles or covets or alternatively the cover means can be retrofitted to a conventional grille or covet.

Preferably the covet means is not provided with any gaps and/or apertures of mote than 8 mm in diameter at any point, thereby meeting safety requirements.

Preferably the apertures located inwardly of the periphery apertures form channels and are defined by first annular members.

In one embodiment the first annular members ate provided at staggered heights and ate located radially inwardly of the edge of the cover means, thus making the entrances of the apertures of the channels non-planar. Second annular members can be provided set back from the entrances of the apertures and these second members direct the flow of liquid through the channels and into the conduit.

According to a second aspect of the present invention there is provided a cover means for an end of a conduit, said cover means comprising a front face covering said conduit end, a back face having attachment means for attachment to said conduit and a plurality of apertures which pass between said front face and back face to allow the flow of a liquid to and/or from the conduit characterised in that the apertures are formed such that the flow of liquid between the front and back faces is deflected so that the liquid follows at least two directions in passing between the front and back faces.

According to a second aspect of the present invention there is provided a covet means for an end of a conduit, said cover means comprising a front face covering said conduit end, a back face having attachment means for attachment to said conduit and a plurality of apertures which pass from said front face to said back face to allow the flow of a liquid to and/or from the conduit and characterised in that one or mote apertures ate provided at one or more locations on a periphery or edge of said front face to enable flow of the liquid through the cover means via the same.

According to a further aspect of the present invention there is provided a cover means for an end of a conduit carrying a liquid, said cover means comprising a front face covering said conduit end and a back face having attachment means for attachment to said conduit, said front face having a plurality of first members which define a series of channels therebetween which pass from said front face to said back face to allow the flow of liquid to and/or from the conduit, said first members being of staggered heights such that the entrances to respective apertures of said channels on said front face ate non planar, second members provided set back from the front face to direct the flow of liquid through said channels.

Typically apertures are provided at one or mote locations on a periphery or edge of said front face to enable flow of liquid through the cover means via the same, The cover means according to the present invention provides a significantly larger surface area through which a liquid can flow compared to conventional grilles. The larger surface area provides a significant reduction in the velocity of the liquid flowing through the same. Since deaths relating to swimming pool grilles typically occur as a result of entrapment of a person on the grille and the velocity of the liquid flowing through the grille, the reduction in velocity through the covet means of the present invention will reduce the risk of a person becoming trapped in the same, thereby providing a significant advantage over conventional grilles.

The covet means according to the present invention is also more efficient at draining liquid through the same due to the provision of means to allow flow of liquid via the edge of the cover means, in addition to flow through apertures on a more central part of the cover means. For example, the cover means according to the present invention typically has a flow rate of 17,000 $mm^2$, compared to approximately 11,000 $mm^2$ through a conventional grille over the same time period. This allows a container, pool and/or the like which is fitted with the cover means to be emptied at a faster rate.

The covert means has the advantage that it provides an anti-vortex effect. A further advantage is that the means covers more of the apparatus and/or drain behind the front face compared to conventional grilles, thereby making the cover means torte aesthetically appealing.

An embodiment of the invention will now be described with reference to the accompanying Figures wherein.

Figure 1:
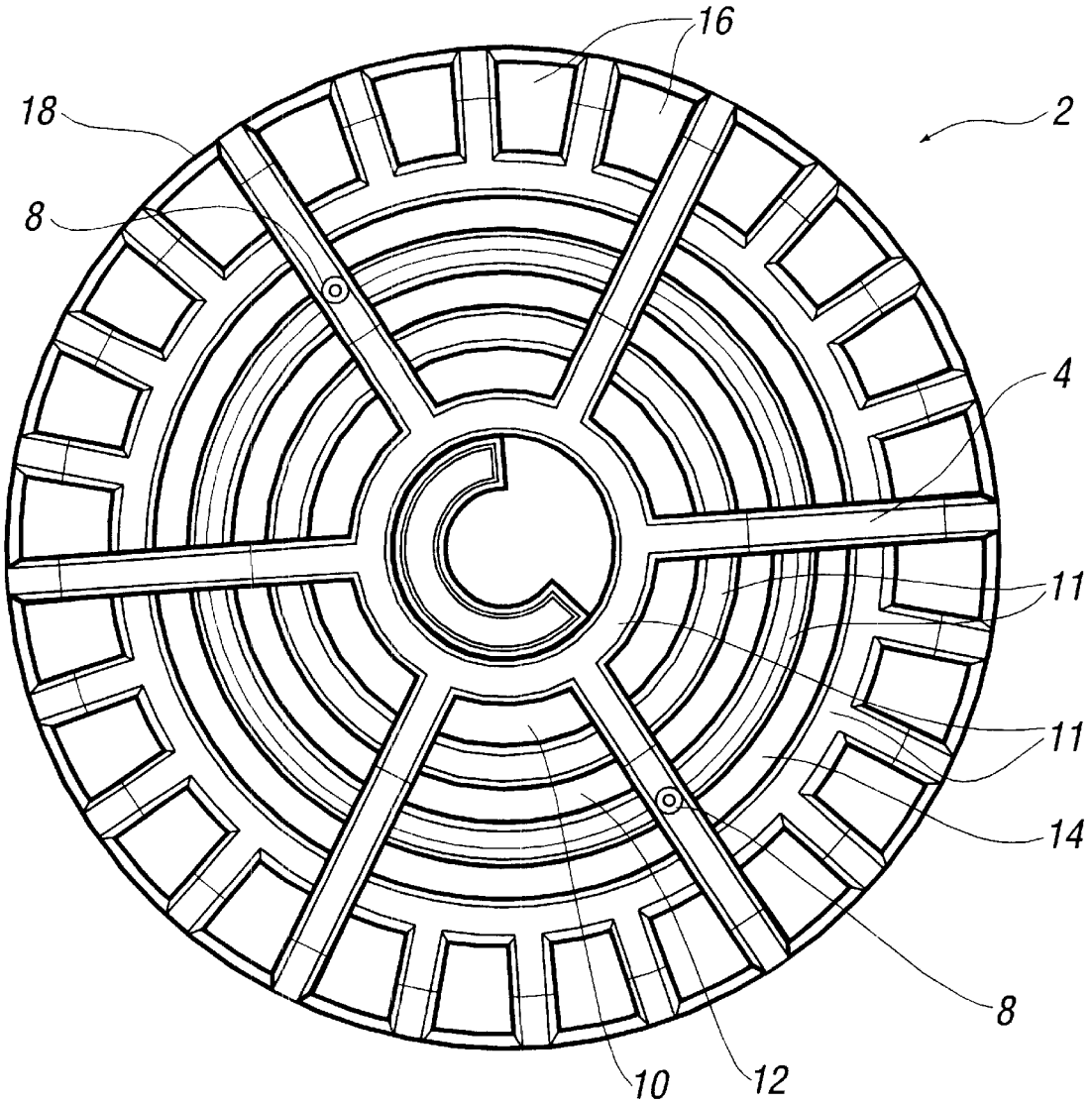
FIG. 1 is a plan view of an embodiment of the covet means.
Figure 2:
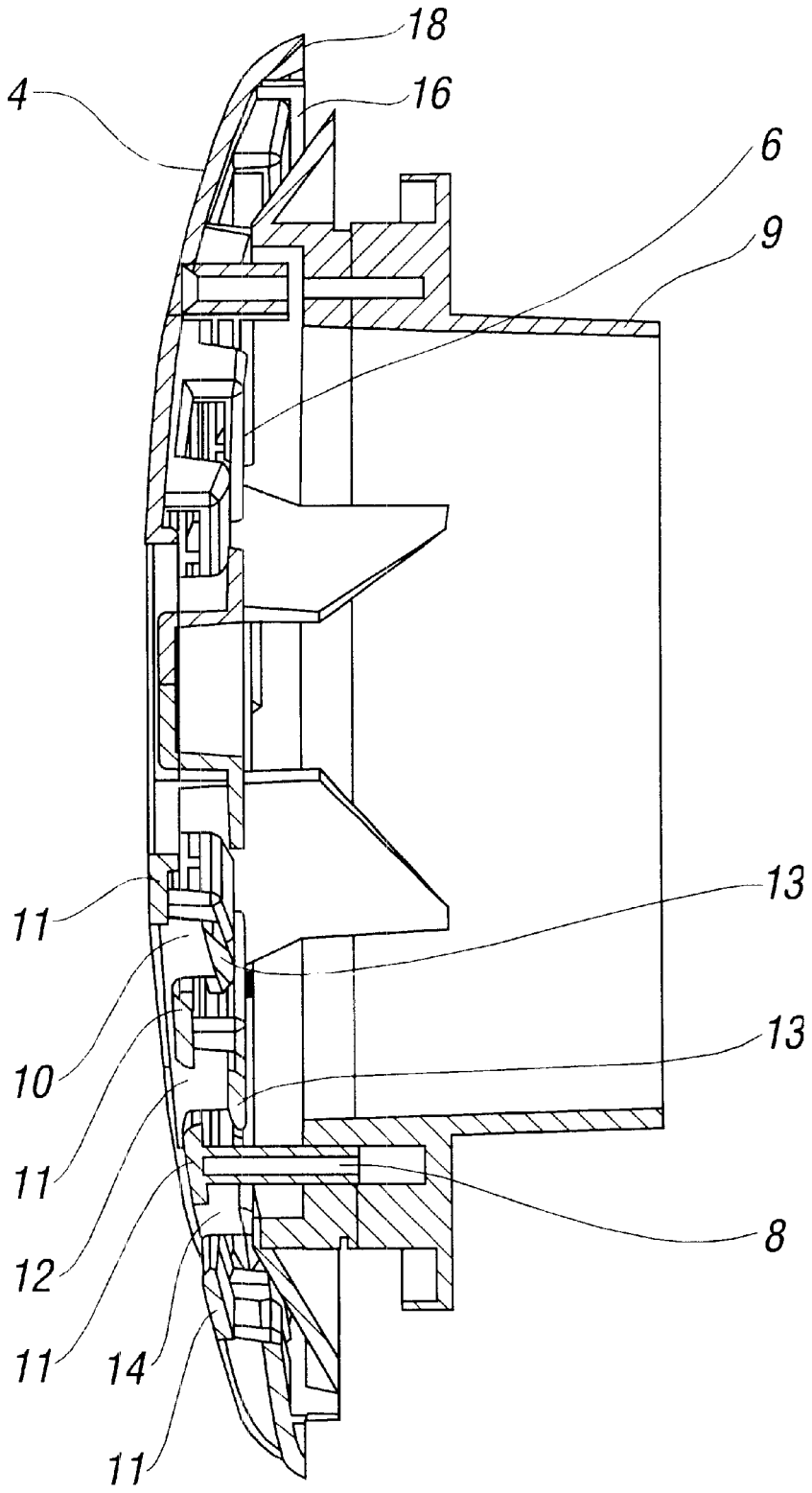
FIG. 2 is a cross sectional view of the cover means in contact with a conduit taken along line A—A in FIG. 1.

Referring to the figures, a cover means 2 Is provided to cover a conduit. The covet means 2 has a front face 4, a back face 6 and attachment means 8 for attaching the cover means 2 to the conduit 9.

The front face 4 is provided with a plurality of annular apertures 10, 12 and 14, which arc defined by first annular members 11. First annular members 11 are provided at staggered heights such that the entrances to the apertures 10, 12 and 14 on the front face 4 are nonplanar.

Figure 3:
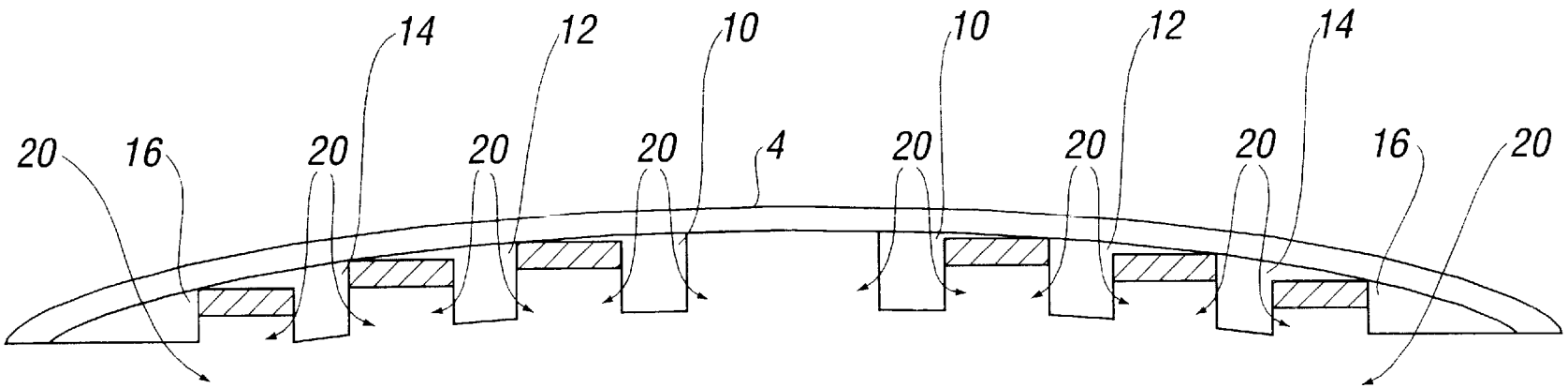
FIG. 3 is a schematic view of the front face of the covet means illustrating the direction of flow through the same.

Second annular members or ribs 13 are provided substantially opposite and set back from the entrances of the apertures 10, 12 and 14 and members 13 help to direct the flow of liquid through the apertures and through side channels, as shown by arrows 20 in FIG. 3. The second annular members, at least in part, allow the flow of liquid between the front and back faces to be deflected so the liquid follows at least two different directions in passing between the front and back faces. At least a portion of the water flowing through the covet contacts the ribs 13 so as to generate this flow.

The annular apertures 10, 12 and 14 are dimensioned such that it is unlikely for a person to get their fingers, hair and/or body part trapped in the same.

Since the apertures ate non-planar it is difficult, if not impossible, for all the apertures to be covered and a vacuum to be created. This prevents a person being sucked onto the cover means and prevents the person's life being endangered as a result of the same.

Apertures 16 are provided at a plurality of locations on the edge 18 of the front face 4. This enables the flow of liquid through the cover means via the edge 18 and prevents a vacuum being created against the cover means.

The attachment means 8 can include a threaded fitting, screws, nut and bolts, clip means and/or the like. The attachment means are detachable from the conduit 9 so that the cover means 2 can be cleaned, repaired or replaced.

The cover means 2 can be made from a plastics material, metal, rubber and/or the like.

The direction of flow of liquid through the apertures 10, 12, 14, 16 on the front face 4 of the covet means 2 is shown by arrows 20, as illustrated in FIG. 3, The arrangement of apertures allows a greater volume of liquid to flow through the cover means during any particular time period compared to conventional grilles.

Thus the present invention provides a covet means 2 which prevents people becoming trapped on the same by preventing a vacuum being created against the same and/or by preventing a person getting a body part trapped in and/or on the covering means.

What is claimed is:

1. A grille for an end of a drainage conduit in a swimming pool, said grille comprising:

a front face for covering an end of a drainage conduit and a back face having attachment portions for attaching to said conduit, said front face and said back face having a plurality of apertures with entrances, said apertures pass between said front face and back face to allow liquid flow to said conduit, a plurality of spaced first annular members defining said entrances on the front face to the apertures;

a plurality of spaced second annular members substantially opposite and set back from said entrances of said apertures forming side channels with said first annular members wherein liquid flow through said apertures from said front face to said back face being deflected, at least in part, by said second annular members directing liquid flow through the apertures and through said side channels so that liquid flow follows one of at least two directions in passing between said front face and said back face.

2. A grille according to claim 1 characterised in that liquid flow through the entrances to said apertures on said front face is initially in an axial direction from the front face toward the back face with said second annular members deflecting liquid flow to a non-axial direction.

3. A grille according to claim 2 characterised in that said grille has a periphery and a series of apertures spaced around the periphery of the grille.

4. A grille according to claim 3 characterised in that the series of apertures are formed so as to cause liquid entering the apertures defined in the front face to flow in at least two directions between the front face and back face to the grille.

5. A grille according to claim 3 characterised in that the deflection of the flow of liquid in two or more directions as it flows between the front face and back face is caused by the provisions of said second annular members onto which at least some of the liquid contacts so as to generate the flow of the liquid to either side of the ribs.

* * * * *